US006820441B2

(12) United States Patent
Maier-Laxhuber et al.

(10) Patent No.: US 6,820,441 B2
(45) Date of Patent: Nov. 23, 2004

(54) ADSORPTION COOLING APPARATUS WITH BUFFER RESERVOIR

(75) Inventors: Peter Maier-Laxhuber, Dietersheim (DE); Andreas Becky, Ottobrunn (DE); Ralf Schmidt, Freising (DE); Reiner Wörz, Reichertshausen (DE); Norbert Weinzierl, Freising (DE)

(73) Assignee: Zeo-Tech Zeolith-Technologie GmbH, Unterschlessheim (DE)

( * ) Notice: Subject to any disclaimer, the term of this patent is extended or adjusted under 35 U.S.C. 154(b) by 0 days.

(21) Appl. No.: 10/657,668

(22) Filed: Sep. 8, 2003

(65) Prior Publication Data

US 2004/0079106 A1 Apr. 29, 2004

(30) Foreign Application Priority Data

Oct. 29, 2002 (DE) ..... 102 50 510

(51) Int. Cl.[7] ..... F25B 17/08; F25B 17/00
(52) U.S. Cl. ..... 62/480; 62/477
(58) Field of Search ..... 62/480, 477

(56) References Cited

U.S. PATENT DOCUMENTS

| | | | | |
|---|---|---|---|---|
| 4,479,364 A | | 10/1984 | Maier-Laxhuber | |
| 4,548,046 A | * | 10/1985 | Brandon et al. | 62/79 |
| 4,660,629 A | | 4/1987 | Maier-Laxhuber et al. | |
| 4,674,563 A | | 6/1987 | Maier-Laxhuber et al. | |
| 4,752,310 A | | 6/1988 | Maier-Laxhuber et al. | |
| 4,802,341 A | | 2/1989 | Maier-Laxhuber et al. | |
| 4,924,676 A | | 5/1990 | Maier-Laxhuber et al. | |
| 4,956,977 A | | 9/1990 | Maier-Laxhuber et al. | |
| 5,038,581 A | | 8/1991 | Maier-Laxhuber et al. | |
| 5,050,403 A | | 9/1991 | Maier-Laxhuber | |
| 5,054,544 A | | 10/1991 | Maier-Laxhuber et al. | |
| 5,207,073 A | | 5/1993 | Maier-Laxhuber et al. | |
| 5,359,861 A | | 11/1994 | Maier-Laxhuber et al. | |
| 5,404,728 A | | 4/1995 | Maier-Laxhuber | |
| 5,415,012 A | | 5/1995 | Maier-Laxhuber et al. | |
| 5,440,896 A | | 8/1995 | Maier-Laxhuber et al. | |
| 5,482,541 A | | 1/1996 | Maier-Laxhuber et al. | |
| 5,518,069 A | | 5/1996 | Maier-Laxhuber et al. | |
| 5,732,569 A | * | 3/1998 | Sanada et al. | 62/481 |
| 5,816,069 A | * | 10/1998 | Ebbeson | 62/457.9 |
| 5,881,573 A | * | 3/1999 | Ebbeson | 62/480 |
| 6,305,186 B1 | * | 10/2001 | Py et al. | 62/480 |
| 6,349,560 B1 | | 2/2002 | Maier-Laxhuber et al. | |
| 6,378,326 B2 | | 4/2002 | Maier-Laxhuber et al. | |
| 6,412,295 B2 | | 7/2002 | Weiss et al. | |
| 6,601,404 B1 | * | 8/2003 | Roderick | 62/480 |

* cited by examiner

*Primary Examiner*—Denise L. Esquivel
*Assistant Examiner*—Filip Zec
(74) *Attorney, Agent, or Firm*—Hoffmann & Baron, LLP

(57) ABSTRACT

Adsorption cooling apparatus with an intermittently heated adsorbent container (12) containing an adsorbent (19) that exothermically adsorbs a working medium during an adsorption phase and again desorbs at higher temperatures while heat is added during a subsequent desorption phase, and with a condenser (4) that leads condensed working medium through a connection line (10) into the evaporator (4) which is in turn connected with the adsorbent through a working medium vapor line (9), wherein the condenser (4) is coupled to a buffer reservoir (14) that buffers at least a part of the condensation heat of the working medium vapor and that also can again dissipate the stored heat into the surroundings even during the adsorption phase.

13 Claims, 2 Drawing Sheets

ADSORPTION COOLING APPARATUS WITH BUFFER RESERVOIR

FIELD OF THE INVENTION

The invention relates to a periodically operating adsorption cooling apparatus with a buffer reservoir and a method for its operation.

BACKGROUND OF THE INVENTION

Adsorption cooling apparatuses are devices in which a solid adsorbent adsorbs a vapor phase working medium with release of heat at an intermediate temperature (adsorption phase). In the process, the working medium evaporates in an evaporator with uptake of heat at a lower temperature. After the adsorption phase, the working medium can again be desorbed by the addition of heat at a higher temperature level (desorption phase). In the process, the working medium evaporates from the adsorbent and flows into a condenser. In the condenser, the working medium is condensed again and then evaporated anew in the evaporator.

Adsorption cooling apparatuses with solid adsorbents are known from EP 0 368 111 and DE-OS 34 25 419. In the process, adsorbent containers, filled with adsorbents, draw in working medium vapor which is produced in an evaporator, and they adsorb it in the adsorbent filling with release of heat. The adsorption heat in the process must be removed from the adsorbent filling. The cooling apparatuses can be used in thermally insulated containers for cooling and keeping warm foodstuffs. These cooling apparatuses contain a shutoff device between the evaporator and the adsorbent. This allows evaporation and adsorption of the working medium at a later time.

The adsorption cooling apparatus which is known from EP 0 368 111 consists of a transportable cooling unit and a stationary charging station that can be separated from the cooling unit. The cooling unit contains an adsorption container, which is filled with a solid adsorbent, and an evaporator with a liquid working medium. Here, too, the evaporator and the adsorption container are connected by a vapor line that can be shut off. Liquid media, which are cooled to the desired temperature level by the temperature-regulated opening and closing of the shutoff device, flow through a heat exchanger embedded in the evaporator. After the adsorbent has become saturated with working medium, it can be heated in the charging station. The working medium vapor that flows out in the process is condensed again in the evaporator. The condensation heat is removed via the cooling water that flows through the embedded heat exchanger.

The shutoff devices serve, on the one hand, the function of uncoupling the evaporator from the remaining cooling apparatus during the desorption phase, in order to prevent hot working medium vapor from flowing into the cold evaporator, and on the other hand, they serve the function of regulating the cold production of the adsorption phase in the evaporator or shifting it to a later time. Without a shutoff device, the evaporator always becomes hot during the desorption phase, and thus the medium to be cooled that is in contact with it becomes warm.

SUMMARY OF THE INVENTION

The problem of the present invention is to protect, in an adsorption cooling apparatus without a shutoff device the medium to be cooled in the desorption phase from impermissible heating.

This problem is solved by an adsorption cooling apparatus of the type having an intermittently heated adsorbent container containing an adsorbent that exothermically adsorbs a working medium during an adsorption phase and with addition of heat again desorbs during a subsequent desorption phase at higher temperatures and with a condenser that leads condensed working medium through a connection line to the evaporator which is in turn connected with the adsorbent through a working medium vapor line and which takes up heat from the medium to be cooled during the adsorption phase, wherein the condenser is coupled to a buffer reservoir that buffers at least a part of the condensation heat of the working medium vapor and that can again dissipate the stored heat into the surroundings even during the adsorption phase.

The coupling of the condenser to a buffer reservoir allows a distinctly more rapid desorption and thus a higher desorption capacity, because the condensation heat, for example, can be removed more effectively due to the starting of convection. The desorption phase can thus be distinctly shortened compared to the adsorption phase. The medium to be cooled is exposed for a shorter period to the high condensation temperatures. In a buffer reservoir of appropriate dimensions, the desorption phase can be reduced to a few minutes, while the adsorption phase can last several hours to several days. During this long adsorption phase, the buffer reservoir can slowly dissipate through small heat exchange surfaces the heat load that was absorbed at high power.

In principle, one can use as a buffer reservoir any of the reservoir media known from the heat reservoir industry, such as liquids, phase change materials (PCM), and solids. Water is cost-effective, and it also allows a high heat transfer capacity. In the process, the condenser can be integrated directly into a water reservoir. The buffered heat is then removed through the external surface of the tank during the slow adsorption phase without an additional heat exchanger, and released into the surrounding air.

It is particularly advantageous for the evaporator to be arranged, with reference to the medium to be cooled, in such a manner that it releases relatively little heat during the desorption phase. This is achieved, for example, by allowing a relatively small amount of medium to be cooled to be in contact with the evaporator, or by omitting any circulation during the desorption phase. If the medium to be cooled is gaseous, as is the case, for example, in refrigerators, it is advantageous for the evaporator to be placed under the ceiling of the refrigerator. Because hot air is lighter than cold air, the cold air mass remains in the lower portion of the refrigerator, while only the air quantity surrounding the evaporator becomes warm. Any goods stored in the refrigerator then remain cold during the relatively short desorption phase. This effect can be further increased by cold storing media and/or radiation screens that are arranged under the evaporator.

For high desorption capacities, high heat conductivity in the adsorbent and good heat transfer from the source of heat are required. It can be particularly advantageous for the heat capacity of the adsorbent, during the desorption phase, to be substantially greater than the heat losses to the surroundings. In this case, one can omit thermal insulation on the adsorbent container casing facing the surroundings. The adsorption heat is then released through the casing during the adsorption phase without additional measures.

It is particularly advantageous to use the adsorption pair zeolite/water. Zeolite is a crystalline mineral which consists of a regular lattice structure made of silicon and aluminum oxides. This lattice structure contains small vacancies in which water molecules can be adsorbed with the release of heat. Within the lattice, the water molecules are exposed to strong field forces that bind the molecules in the lattice in a liquid-like phase. The strength of the binding forces which act on the water molecule is a function of the preadsorbed quantity of water and the temperature of the zeolites. For practical use, up to 25 g of water can be adsorbed per 100 g of zeolite. Zeolites are solid substances without troublesome heat expansion during the adsorption or desorption reaction. The lattice is freely accessible from all sides to the water vapor molecules. The apparatuses are therefore operational in any position.

The use of water as working medium makes it possible to reduce the required regulation effort to a minimum. During the evaporation of water under a vacuum, the water surface cools to 0° C. and, during continued evaporation, it freezes to ice. The ice layer can be used advantageously for regulating the temperature of the medium to be cooled. If there is little addition of heat, the ice layer grows, whereas, if a large amount of heat is added, it disappears as a result of melting. Due to the formation of ice, heat transfer is reduced from the medium to be cooled into the evaporator, so that the medium cannot be cooled below 0° C. If evaporation is continued, the entire water reserve can turn to ice in the evaporator. The sublimation temperature of the ice layer then decreases to less than 0° C.

It is also possible to add substances that lower the freezing point to the aqueous evaporator contents, if the temperature of the medium to be cooled is to be lowered below 0° C.

Other adsorbent pairs can also be used where the adsorbent is solid and remains solid even during the adsorption reaction. Solid adsorbents have low heat conductivity and limited heat transfer. Because the heat transfer from the adsorbent container to the surrounding air that takes up heat is of the same order of magnitude, heat exchangers without ribs are recommended in principle, for example, plates, pipes and corrugated metal tubes. Some solid adsorbents, such as zeolites, are sufficiently sturdy to compensate even for external excess pressures on thin-walled heat exchanger surfaces. Additional reinforcements or thick-walled heat exchanger surfaces are therefore not necessary.

Moreover, solid adsorbents can be processed into molded bodies. A single molded body, or a few molded bodies, can form a complete cost-effective adsorbent filling.

For an economical operating procedure with zeolite/water systems, it is recommended to use desorption final temperatures of 200–300° C. and adsorption final temperatures of 40–80° C. Because zeolite granulates have a particularly low heat conductivity, the adsorbent containers should be designed so that the heat conductivity path for the processed quantities of heat does not exceed 3 cm.

As a heat source for the desorption phase, any of the known devices are suitable, provided that the temperature level required for the desorption reaction is achieved with them. Electrically heated plates or cartridges whose geometry is adapted to the adsorbent container are advantageous. Also suitable are heating devices which heat the adsorbent filling by radiation or induction (eddy current). The heating surface used during heating of the adsorbent with a flame can also be used as a heat exchanger surface for heat release during the adsorption phase. It is thus possible to omit the conventional double installation of heat exchanger surfaces.

It can also be advantageous to adapt the geometry of the adsorbent container specifically to heat release during the adsorption phase. In the case of heat release into the surrounding air, it is preferred to use large heat exchanger surfaces that promote flow.

The working medium condenses predominantly in the condenser. The condensate must be led from there to the evaporator. If the adsorption cooling apparatus is simply constructed, then the condensate must be able to flow back into the evaporator without additional help. This is always easy to achieve if the condenser and thus also the heat buffer are in a higher position than the evaporator. The condensate can then surely flow back during the desorption phase by gravity. In cooling apparatuses where this is not possible, it can be advantageous for the condensate to be stored in the condenser or in a collection tank, to be drawn upward into the evaporator at the beginning of the adsorption phase, when the vapor pressure in the evaporator decreases.

Expensive electronic regulation must be omitted in cost-effective cooling apparatuses. However, since adsorption apparatuses necessarily produce a highly variable cooling power, it is advantageous for the cooling power to be limited in a simple manner. According to the invention, the cross section of the working medium vapor line to the adsorbent is decreased for that purpose. This can also be achieved, for example, by expansion elements that decrease the cross section of the pipe to the adsorbent with decreasing temperature. Bimetal elements that are incorporated in the evaporator are a particularly cost-effective way of narrowing the outlet of the evaporator with decreasing evaporation temperatures.

Because the evaporator, as a function of the system, is raised to the termperature level of condensation with each desorption, and because, at the beginning of the adsorption phase, it must again be cooled to the lower temperature level of evaporation by evaporation of a portion of the working medium, it is advantageous to keep the thermal mass of the evaporator low and to set the quantity of liquid working medium such that, to the extent possible, the entire working medium is evaporated at the end of the adsorption phase. Toward the end of adsorption, the quantity of working medium in the evaporator becomes increasingly smaller, and, consequently the wetting of the heat exchanger surface to allow the uptake of heat from the medium to be cooled becomes increasingly more difficult. According to the invention, the evaporator contains wetting agents for this operational state that distribute the remaining working medium homogeneously over the internal evaporation surface. For this purpose, nonwoven glass fiber materials have been shown to be satisfactory; they are applied as a thin layer on the corresponding evaporator surfaces.

A preferred form of the adsorption cooling apparatus according to the present invention, as well as other embodiments, objects, features and advantages of this invention will be apparent from the following detailed description of illustrative embodiments thereof, which is to be read in conjunction with the accompanying drawings.

BRIEF DESCRIPTION OF THE DRAWINGS

In the drawings, the invention is represented using as an example two electrically heated refrigerators.

DETAILED DESCRIPTION OF THE PREFERRED EMBODIMENTS

Figure 1:
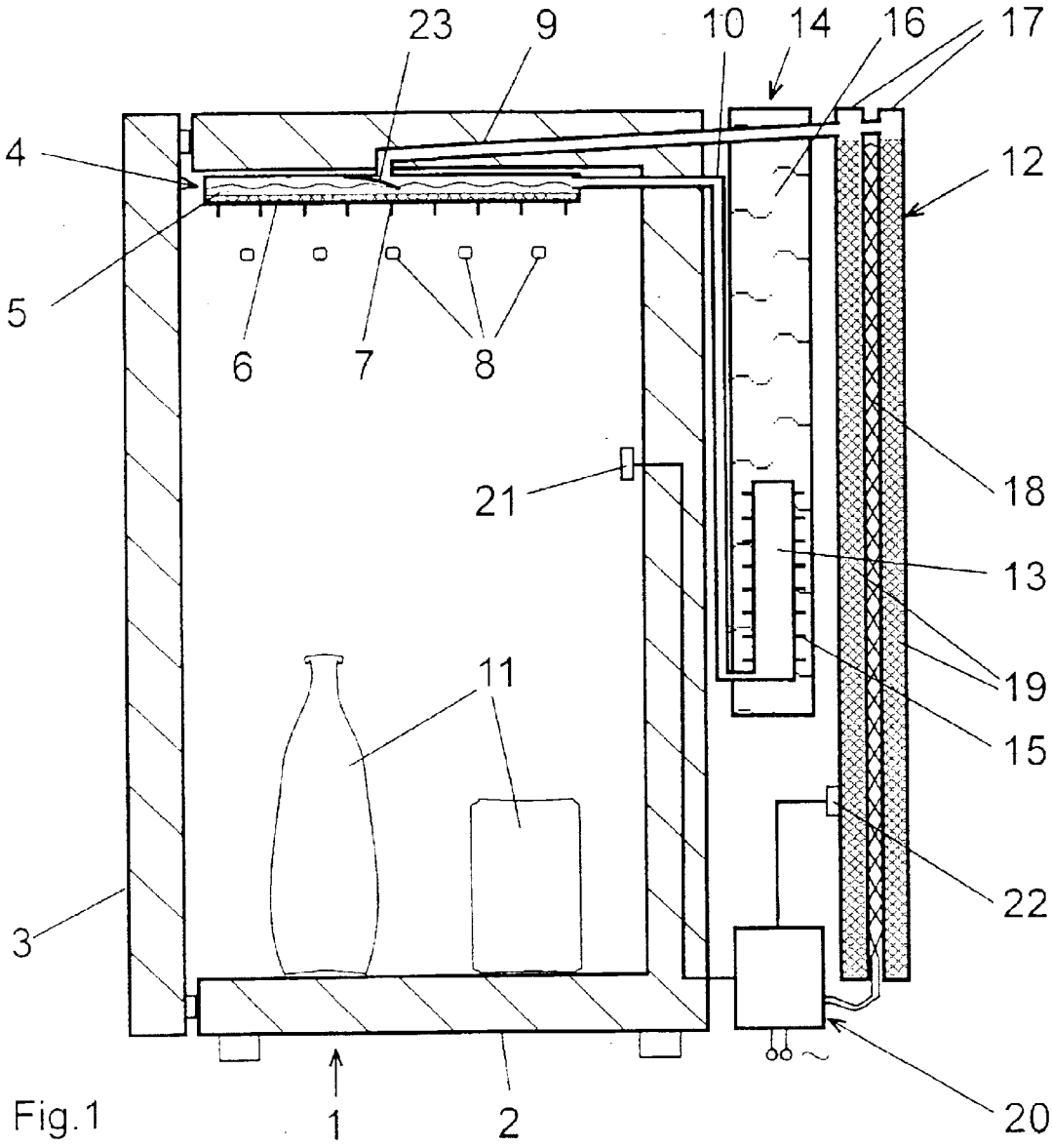
FIG. 1 is a cross section of an adsorption cooling apparatus with a condenser located at a lower position.

A refrigerator 1, represented in FIG. 1, consists of a thermally insulated hollow body 2, which is closed at its front side by a door 3 and which cools and stores in the internal space foodstuffs and drink bottles 11 at cold temperature. The medium to be cooled by the evaporator in this application is the air in the internal space of the refrigerator.

An evaporator 4 is arranged under the ceiling of the refrigerator 1, from which the working medium water 5 evaporates. The evaporator 4 is connected through a working medium vapor line 9 to an adsorbent container 12 and through an additional connection line 10 with a condenser 13. The evaporator 4 is covered on its bottom internal side with an absorbent fiber nonwoven material 6 that distributes the working medium water homogeneously over the heat uptake surface. It contains several cooling ribs 7 on the outside that take up heat from the medium to be cooled, air. A layer of elements 8 that store cold is located under the cooling ribs 7; the elements contain water and they also can freeze. In front of the opening of the working medium vapor line 9 is arranged a bimetal element 23 that narrows the outlet opening to the adsorbent container as the evaporator temperature decreases. The condenser 13, which is provided with heat exchanger ribs 15, is located in the lower area of a buffer reservoir 14 that is filled with water 16. The adsorbent container 12 consists of two metal adsorber jackets 17 with an electrical heating 18 in the middle embedded. The adsorber jackets 17 each contain an adsorbent filling 19 that is constructed from molded zeolite bodies.

A regulator 20 controls the operation of heating 18 as a function of the temperature of the refrigerator air and the temperature of the adsorbent fitting 19. The input quantities for the regulator 20 are the air temperatures in the refrigerator, which are determined by a temperature sensor 21, and the zeolite temperature, which is reported by a zeolite temperature sensor 22.

The function of the refrigerator according to the invention can be subdivided into a relatively short desorption phase and a distinctly longer adsorption phase.

The desorption phase starts with heating of the adsorbent filling 19. The temperature sensor 21 reports to the regulator 20 exceeding the preselected temperature of the refrigerator air. Electrical heating 18 is then operated until the zeolite temperature sensor 22 observes that the desorption final temperature has been reached. During the heating phase, water vapor is expelled from the adsorbent filling 19 which continues to become warmer, and the vapor flows through the working medium vapor line 9, the evaporator 4, and the connecting line 10 into the condenser 13. In the latter, the vapor is condensed as a result of the release of heat to the buffer water 16 through the heat exchanger ribs 15. The condensate collects in the bottom area of the condenser 13. A small part of the water vapor condenses in the evaporator 4 until the latter's temperature has risen to the temperature level of the condenser 13. The masses of air around the evaporator 4 also become warmer. Since this quantity of air is lighter than the cold air in the lower refrigerator area, no mixing occurs. In addition, the cold storing element 8 prevents any noticeable warming of the drink bottles 11 in the refrigerator (for example, as a result of heat radiation).

The adsorbent container jackets 17, which are in contact with the surrounding air, release heat during the desorption phase. However, since this phase is kept short according to the invention and the heat losses are low relative to the high heat capacity, thermal insulation of the external adsorbent container jackets 17 can be omitted. In addition, a relatively strong temperature gradient forms inside the adsorbent filling 19. Thus, temperatures of up to 400° C. can be measured near the electrical heating 18, while the zeolite in contact with the external adsorption container sheaths 17 is heated only to temperatures of 140° C. The heat losses to the surroundings from this low temperature level are distinctly lower. In addition, these temperatures occur only at the end of the desorption phase. Once the final desorption temperature has been reached, heating is switched off. At this time, the buffer reservoir has reached its highest temperature. This now decreases continuously during the following adsorption phase because heat slowly flows into the surroundings through the container walls.

Heat also continues to flow through the non-thermally insulated adsorption container jackets 17 into the surrounding air that flows by. The temperature of the adsorbent filling 19 decreases as a result, and the working medium vapor flows back into the adsorbent container 12. The vapor pressure in the evaporator then decreases until the condensate is drawn upward out of the condenser. At that time the entire quantity of liquid working medium is located in the evaporator 4. If cooling of the adsorbent filling 19 is continued, this water mass will also evaporate in the evaporator 4 during the course of the adsorption phase with the uptake of heat of evaporation. At evaporation temperatures below the freezing point, the remaining water quantity will gradually turn into ice. The bimetal element 23 that narrows the inflow opening in the working medium vapor line 9 prevents potential cooling to temperatures much below the freezing point. The end of the adsorption phase is reached when the regulator 20 records an excessively high air temperature in the refrigerator. The desorption phase then starts from the beginning by heating the adsorbent filling 19.

Figure 2:
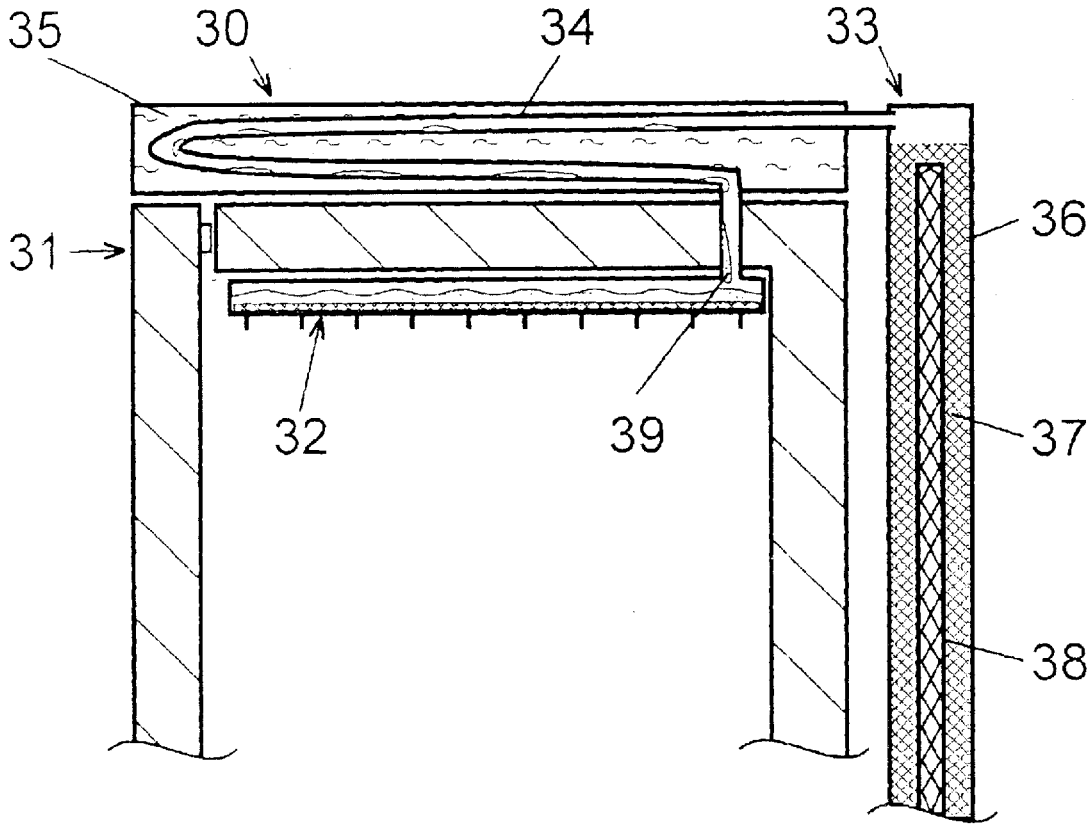
FIG. 2 shows the upper portion of an adsorption cooling apparatus with a condenser that is higher than the evaporator.

In the adsorption refrigerator represented in FIG. 2, the buffer reservoir 30 is located above the evaporator 32. From the adsorbent container 33, the working medium vapor line 34 runs through the buffer reservoir 30 to be able to effectively remove the condensation heat from its volume of water 35. The part of the working medium vapor line 34 that can release heat to the value of water 35 accordingly has the same function as the condenser. The working medium vapor line 34 is arranged at a slant, so that the condensate 39 can readily flow off during the desorption phase by gravity without any additional measures, directly into the evaporator 32. The adsorption container 33 in this variant consists of an internal heating cartridge 38 and an adsorbent filling 37, which is surrounded by a cylindrical adsorber jacket 36. The latter also does not need any thermal insulation, because the heat losses are low due to the short desorption phases and the large temperature gradient inside the adsorbent filling 37.

The operational procedure of the cooling apparatus according to FIG. 2 is identical to that described above for the apparatus according to FIG. 1. The only difference is that the condensate 39 does not remain in the condenser, but rather can readily flow off during the desorption phase into the evaporator 32.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An adsorption cooling apparatus with an intermittently heated adsorbent container containing an adsorbent that exothermically adsorbs a working medium during an adsorption phase and with addition of heat again desorbs during a subsequent desorption phase at higher temperatures and with a condenser that leads condensed working medium through a connection line to an evaporator which is in turn connected with the adsorbent through a working medium vapor line and which takes up heat from the medium to be cooled during the adsorption phase, wherein the condenser is disposed within a buffer reservoir having a reservoir medium contained therein that buffers at least a part of the condensation heat of the working medium vapor and that can again dissipate the stored heat into the surroundings even during the adsorption phase.

2. An adsorption cooling apparatus according to claim 1, wherein the evaporator is arranged in the upper region of the medium to be cooled and the medium that is being heated during the desorption phase does not mix with the cooler medium located below it because of its lower density.

3. An adsorption cooling apparatus according to claim 1, further comprising a cold storing element arranged below the evaporator.

4. An adsorption cooling apparatus according to claim 1, wherein during the desorption phase, the medium to be cooled is prevented from exchanging heat with the already cooled medium by means of a shutoff device.

5. An adsorption cooling apparatus according to claim 1, wherein the desorption heat that is added during the desorption phase is input by a burner.

6. An adsorption cooling apparatus according to claim 1, wherein the adsorbent contains zeolite and the working medium contains water.

7. An adsorption cooling apparatus according to claim 1, wherein a condensate is collected in a condensate buffer at a lower level, and is drawn into the higher level of the evaporator at the beginning of the adsorption phase.

8. An adsorption cooling apparatus with an intermittently heated adsorbent container containing an adsorbent that exothermically adsorbs a working medium during an adsorotion phase and with addition of heat again desorbs during a subsequent desorption phase at higher temperatures and with a condenser that leads condensed working medium through a connection line to an evaporator which is in turn connected with the adsorbent through a working medium vapor line and which takes up heat from the medium to be cooled during the adsorption phase, wherein the condenser is coupled to a buffer reservoir that buffers at least a part of the condensation heat of the working medium vapor and that can again dissipate the stored heat into the surroundings even during the adsorption phase, and wherein the evaporator contains wetting agents which effect a homogeneous distribution of the liquid working medium inside the evaporator.

9. An adsorption cooling apparatus with an intermittently heated adsorbent container containing an adsorbent that exothermically adsorbs a working medium during an adsorption phase and with addition of heat again desorbs during a subsequent desorption phase and higher temperatures and with a condenser that leads condensed working medium through a connection line to an evaporator which is in turn connected with the adsorbent through a working medium vapor line and which takes un heat from the medium to be cooled during the adsorption phase, wherein the condenser is coupled to a buffer reservoir that buffers at least a part of the condensation heal of the working medium vapor and that can again dissipate the stored heat into the surroundings even during the adsorption phase, and wherein the working medium vapor line contains a regulation element which narrows the flow cross section when the evaporator temperatures are too low.

10. An adsorption cooling apparatus according to claim 9, wherein the regulation element contains a bimetal element.

11. An adsorption cooling apparatus according to claim 1, further comprising a radiation screen arranged below the evaporator.

12. A method for the operation of an adsorption cooling apparatus with an intermittently heated adsorbent container containing an adsorbent that exothermically adsorbs a working medium during an adsorption phase, and that, with addition of heat, again desorbs during a subsequent desorption phase at higher temperatures, and with a connected condenser disposed within a buffer reservoir and that leads condensed working medium into an evaporator which is in turn connected with the adsorbent through a working medium vapor line, wherein the desorption phase has less than one-third the duration of the adsorption phase, and that the condensation heat is buffered during the desorption phase by a heat reservoir medium contained within the buffer reservoir and that most of the buffered heat is again dissipated during the adsorption phase.

13. A method for the operation of an adsorption cooling apparatus according to claim 12, wherein during the desorption phase, which is caused by a high heating power, a temperature gradient of more than 100 K between the heat uptake surface and the heat release surface is produced inside the adsorbent.

* * * * *

UNITED STATES PATENT AND TRADEMARK OFFICE

CERTIFICATE OF CORRECTION

PATENT NO. : 6,820,441 B2
DATED : November 23, 2004
INVENTOR(S) : Maier-Laxhuber et al.

It is certified that error appears in the above-identified patent and that said Letters Patent is hereby corrected as shown below:

Column 4,
Line 30, now reads “termperature” should read -- temperature --

Column 7,
Lines 32-33, now reads “adsorotion” should read -- adsorption --

Column 8,
Line 9, now reads “which takes un heat” should read -- which takes up heat --
Line 12, now reads “condensation heal” should read -- condensation heat --

Signed and Sealed this

Twenty-sixth Day of April, 2005

JON W. DUDAS
*Director of the United States Patent and Trademark Office*